US011542606B2

(12) United States Patent
Park et al.

(10) Patent No.: US 11,542,606 B2
(45) Date of Patent: Jan. 3, 2023

(54) METHOD OF TIN-PLATING COPPER ALLOY FOR ELECTRIC OR ELECTRONIC PARTS AND AUTOMOBILE PARTS AND TIN-PLATING MATERIAL OF COPPER ALLOY MANUFACTURED THEREFROM

(71) Applicant: Poongsan Corporation, Pyeongtaek-Si (KR)

(72) Inventors: Cheol Min Park, Ulsan (KR); Hyo Moon Nam, Ulsan (KR); Buem Jae Lee, Ulsan (KR); Hyo Young Kim, Ulsan (KR)

(73) Assignee: Poongsan Corporation, Pyeongtaek-Si (KR)

( * ) Notice: Subject to any disclaimer, the term of this patent is extended or adjusted under 35 U.S.C. 154(b) by 778 days.

(21) Appl. No.: 16/462,209

(22) PCT Filed: May 8, 2018

(86) PCT No.: PCT/KR2018/005248

§ 371 (c)(1),
(2) Date: May 17, 2019

(87) PCT Pub. No.: WO2018/225957

PCT Pub. Date: Dec. 13, 2018

(65) Prior Publication Data

US 2019/0330743 A1 Oct. 31, 2019

(30) Foreign Application Priority Data

Jun. 8, 2017 (KR) ..... 10-2017-0071794

(51) Int. Cl.
*C23C 22/17* (2006.01)
*C23C 22/07* (2006.01)
(Continued)

(52) U.S. Cl.
CPC ..... *C23C 22/17* (2013.01); *C23C 22/07* (2013.01); *C25D 3/30* (2013.01); *C25D 3/38* (2013.01);
(Continued)

(58) Field of Classification Search
CPC ..... C25D 3/30–32; C25D 3/12–18; C23F 11/167–1673
See application file for complete search history.

(56) References Cited

U.S. PATENT DOCUMENTS

2008/0056930 A1 3/2008 Ito et al.
2010/0151263 A1* 6/2010 Abys ..... H05K 3/282 428/457
(Continued)

FOREIGN PATENT DOCUMENTS

CN 106795642 A 8/2012
CN 102482794 A 6/2016
(Continued)

OTHER PUBLICATIONS

Nagano, Machine Translation, KR 20120023185 A (Year: 2012).*
(Continued)

*Primary Examiner* — Ho-Sung Chung
(74) *Attorney, Agent, or Firm* — Loeb & Loeb LLP

(57) ABSTRACT

The present invention provides a method of tin-plating a copper alloy for electric or electronic parts and automobile parts which has excellent insertion force, heat-resistant peeling, and solderability, and a tin-plating material of a copper alloy manufactured therefrom.

8 Claims, 2 Drawing Sheets

(51) Int. Cl.

| | |
|---|---|
| ***C25D 3/30*** | (2006.01) |
| ***C25D 3/38*** | (2006.01) |
| ***C25D 3/56*** | (2006.01) |
| ***C25D 3/60*** | (2006.01) |
| ***C25D 5/12*** | (2006.01) |
| ***C25D 5/34*** | (2006.01) |
| ***C25D 5/50*** | (2006.01) |
| ***C25F 1/02*** | (2006.01) |
| ***C25D 5/48*** | (2006.01) |
| ***C25D 5/10*** | (2006.01) |
| ***C25D 7/00*** | (2006.01) |
| ***C25D 5/00*** | (2006.01) |

(52) U.S. Cl.

CPC ..... *C25D 3/562* (2013.01); *C25D 3/60* (2013.01); *C25D 5/10* (2013.01); *C25D 5/12* (2013.01); *C25D 5/34* (2013.01); *C25D 5/48* (2013.01); *C25D 5/505* (2013.01); *C25D 5/611* (2020.08); *C25D 5/617* (2020.08); *C25D 5/627* (2020.08); *C25D 7/00* (2013.01); *C25F 1/02* (2013.01)

(56) References Cited

U.S. PATENT DOCUMENTS

| | | | | |
|---|---|---|---|---|
| 2010/0170595 | A1 | 7/2010 | Kaneko et al. | |
| 2012/0244374 | A1* | 9/2012 | Drollinger ..... | C25D 17/08 428/603 |

FOREIGN PATENT DOCUMENTS

| | | | | |
|---|---|---|---|---|
| JP | 0148355 | B2 | | 10/1989 |
| JP | 2007002341 | A | | 1/2007 |
| JP | 2007123209 | A | | 5/2007 |
| JP | 2013174008 | A | | 9/2013 |
| JP | 2016113695 | A | | 9/2013 |
| JP | 2014040675 | A | | 3/2014 |
| JP | 2015143385 | A | | 8/2015 |
| KR | 10-2006-0105509 | A | | 10/2006 |
| KR | 10-2012-0023185 | A | | 3/2012 |
| KR | 10-2012-7001034 | A | | 3/2012 |
| KR | 20120023185 | A | * | 3/2012 |
| KR | 10-2012-0085853 | A | | 8/2012 |
| KR | 20160029033 | A | | 3/2016 |
| KR | 10-2016-0070469 | A | | 6/2016 |
| KR | 20160070469 | A | * | 6/2016 |

OTHER PUBLICATIONS

Lee et al., Machine Translation, KR 20160070469 A (Year: 2016).*
Chemspider, hypodiphosphoric acid (Year: 2022).*
Egan et al., Density of Aqueous Solutions of Phosphoric Acid, Ind'l & Eng. Chem. 1280 (Year: 1955).*
PubChem, Phosphoric acid, butyl ester (Year: 2022).*
Millipore Sigma, Phosphorous acid (Year: 2022).*
Chemsrc, Phosphorous acid,trihexyl ester (Year: 2022).*
Bell et al., The Formula of Hypophosphoric Acid, J. of the Chem. Society 48 (Year: 1933).*
Japan Patent Office, Notice of Reason for Rejection for Patent Application No. 2019-520834, dated Apr. 21, 2020, 15 pages.
Korean Intellectual Property Office, Notice of Allowance, dated Aug. 20, 2018, 15 pages.
Korean Intellectual Property Office, International Search Report, dated Aug. 14, 2018, 15 pages.
China National Intellectual Property Administration, First Office Action, dated Jun. 11, 2020, 14 pages.

* cited by examiner

【Figure 1】
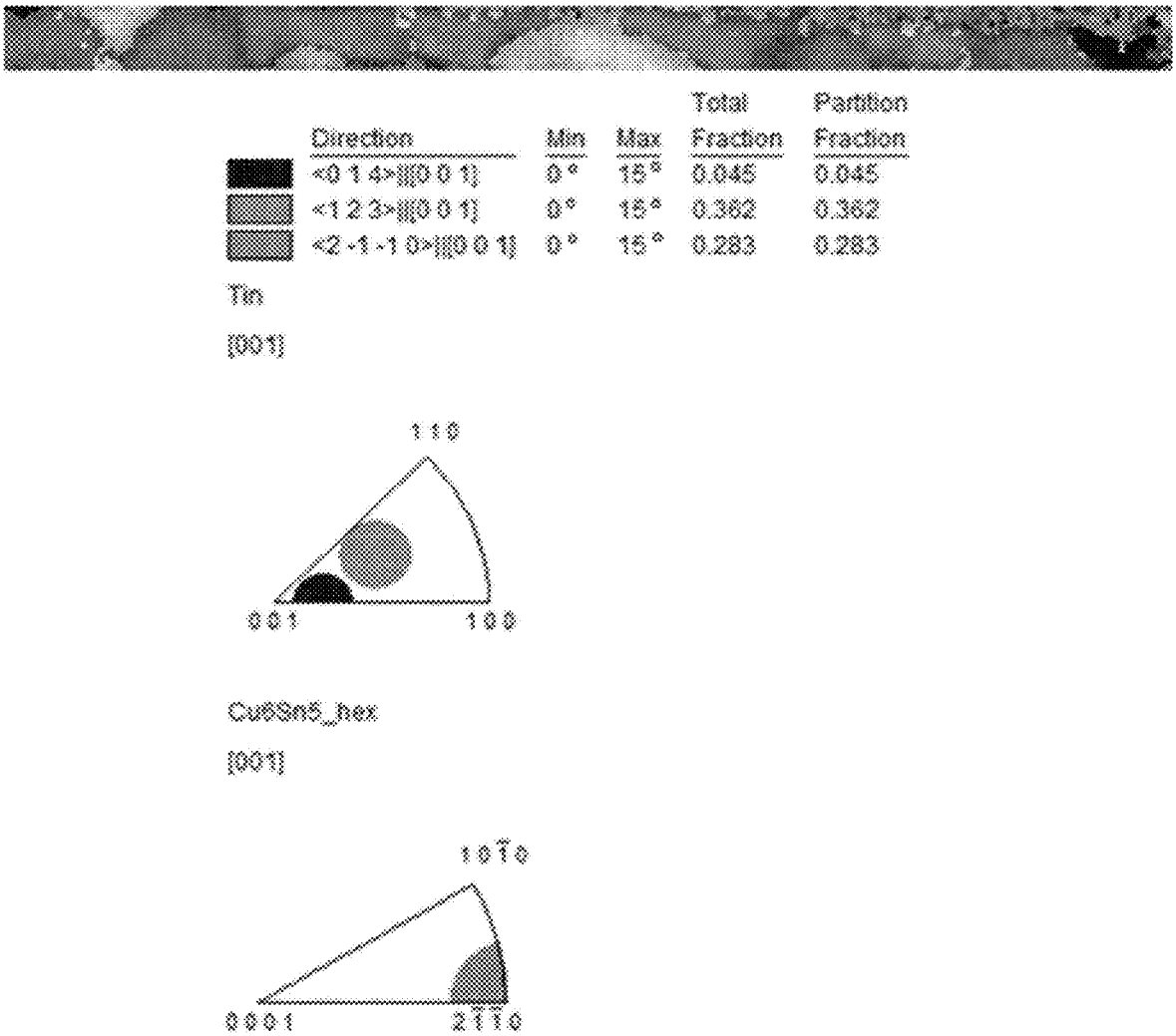

【Figure 2】
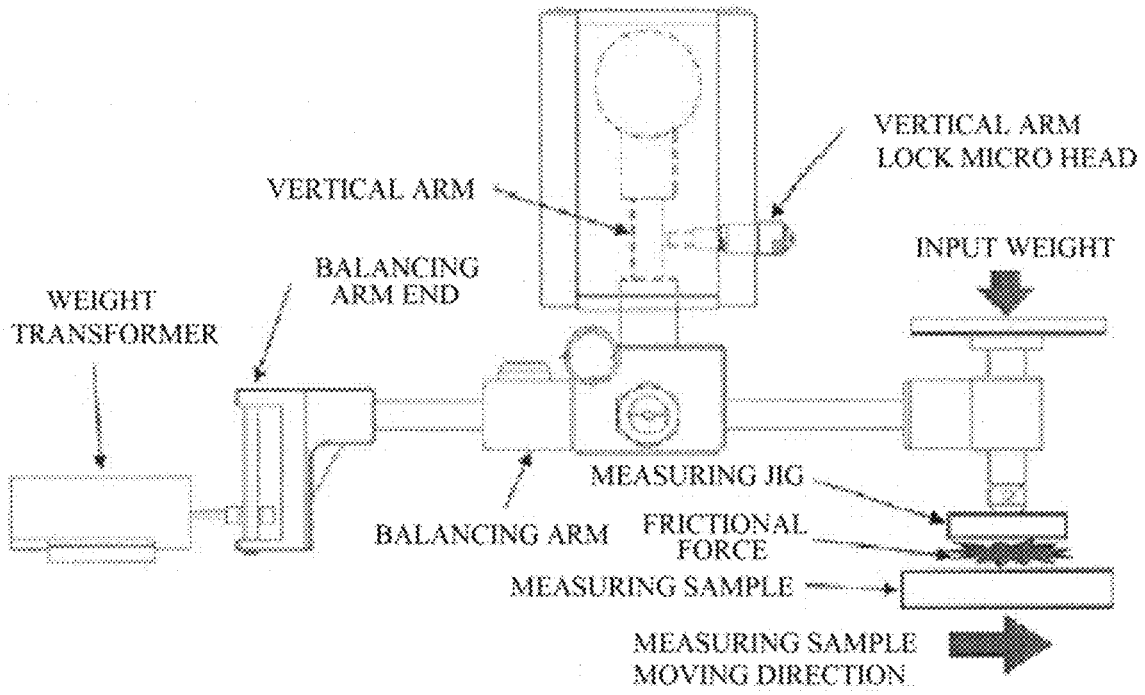

METHOD OF TIN-PLATING COPPER ALLOY FOR ELECTRIC OR ELECTRONIC PARTS AND AUTOMOBILE PARTS AND TIN-PLATING MATERIAL OF COPPER ALLOY MANUFACTURED THEREFROM

CROSS REFERENCE OF RELATED APPLICATIONS

The present application is a U.S. national stage of a PCT international application, Serial no. PCT/KR2018/005248, filed on May 8, 2018, which claims the priority of Korean patent application No. 10-2017-0071794, filed with KIPO of Republic of Korea on Jun. 8, 2017, the entire content of these applications are incorporated into the present application by reference herein.

TECHNICAL FIELD

The instant disclosure relates to a method for plating tin on a copper alloy for an electric or electronic part or automobile part, and to a tin-plating material for the copper alloy manufactured therefrom.

BACKGROUND

A tin-plating material for a copper alloy containing copper is mainly used for an electric or electronic part, an automotive connector, a terminal relay, a switch part, and the like. These electric or electronic part and automobile part are sometimes used in an extreme operating environment such as an automotive engine room. In this connection, an ambient temperature rises to 125 to 150° C. Thus, as time goes by, a Cu—Sn compound is diffused onto a plating surface, and an area of a tin-plated layer is minimized. Therefore, properties of the tin-plated layer such as a corrosion resistance, a contact resistance, a solderability, and the like are deteriorated. Especially, as a terminal miniaturization, which is a recent tendency, a thickness of a copper alloy material tends to become thinner. As a thickness of the material becomes thinner, a thermal conductivity of the material itself becomes higher, accelerating the deterioration of the tin-plated layer. Therefore, a peeling phenomenon of the tin-plated layer becomes more likely to occur. That is, a heat-resistant peeling property of the tin-plated layer of the copper or copper alloy is further required in such an environment.

Further, as the miniaturization of the electric and electronic parts, the automotive connector, the terminal relay, and the switch parts, the number of terminal pins constituting the same continues to increase. Thus, an insertion force is an important issue for field workers during terminal assembling. Specifically, for example, when assembling a car, the workers will repeatedly assemble 200 or more terminals. When the insertion force on the terminal is excessive, the insertion force may strain worker's musculoskeletal system, and even cause musculoskeletal disorders. Therefore, the automobile industry in developed countries regulates the insertion force per terminal. Because of this, terminal companies have been reducing the insertion force by optimizing a part shape design. However, there is a limitation that the design optimization may not overcome. Thus, recently, many researches have been conducted to reduce a frictional resistance of the tin-plated layer of the copper alloy for the terminal to reduce the insertion force.

In Japanese Patent Application No. 2013-071988, when a surface area rate of a Cu—Sn compound on a surface of a tin plating is 3 to 75%, an average crystal particle diameter is below 2 μm, and a roughness of the tin plating surface is 3.0 μm or below, a surface friction decreases, thereby reducing the insertion force.

In Japanese Patent Application No. 2013-001484, a tin-plated copper alloy terminal material and a method for manufacturing thereof reducing a dynamic friction coefficient to lower than or equal to 0.3 while exhibiting an excellent electrical connection property, and having an excellent insertion-exclusion property was disclosed. The tin-plated copper alloy terminal material is a material in which a Sn-based surface layer is formed on a surface of a substrate made of a Cu or Cu alloy, and a Cu—Ni—Sn alloy layer containing Ni is formed between the Sn-based surface layer and the substrate. The Cu—Ni—Sn alloy layer contains Ni at 10 at % or more and 40 at % or less. Further, the Cu—Ni—Sn alloy layer is constituted by Cu—Ni—Sn alloy particles of a fine columnar crystal having a cross-sectional diameter of 0.1 μm or above and 0.8 μm or below, and an aspect ratio of 1.5 or above and coarse and loose Cu—Ni—Sn alloy particles having a cross-sectional diameter of above 0.8 μm. Further, an average thickness of the Sn-based surface layer is 0.2 μm or above and 0.6 μm or below, and an area rate of the Cu—Ni—Sn alloy layer exposed to the surface of the Sn-based surface layer is 10% or above and 40% or below. Then, a dynamic friction coefficient is 0.3 or below.

However, exposing the Cu—Ni—Sn alloy layer to the surface has reduces the dynamic friction coefficient. However, the heat-resistant peeling property and the solderability are decreased.

That is, like Japanese Patent Application No. 2013-071988, and Japanese Patent Application No. 2013-001484, in the existing method for tin plating the copper alloy, a copper plating or an underlying plated layer, which is a combination of a nickel plating and the copper plating is followed by a tin plating. Then, a reflow-treatment is performed to expose a Cu—Sn compound or Cu—Sn—Ni compound on the tin plating to reduce the insertion force. However, in this case, an area ratio of the tin layer is relatively low. Thus, the heat-resistant peeling property and the solderability are lowered.

SUMMARY

In order to solve the above-mentioned problems, the instant disclosure aims to provide a method for plating tin on a copper alloy, and a tin-plating material for the copper alloy manufactured therefrom. The tin-plating material has excellent heat-resistant peeling property and solderability while maintaining a low insertion force.

In one aspect, there is provided a method for plating tin on a copper alloy for an electric or electronic part or automobile part, the method including: (a) electrolytic-degreasing and pickling a copper alloy base material; (b) plating an underlying copper layer on the copper alloy base material; (c) plating a tin or tin alloy layer on the underlying copper layer; (d) surface-treating the tin or tin alloy layer by mist-spraying a surface-treatment agent thereon to form a product; and (e) reflow-treating the product, wherein the reflow-treatment includes performing a first heat treating of the product at a temperature of 200 to 250° C. for 1 to 30 seconds, then a second heat treating of the product at a temperature of 300 to 700° C. for 3 to 1200 seconds, wherein an EBDS analysis of a resulting product shows that: a fraction in a crystal direction of <2-1-10>|[001] of a Cu—Sn compound ($Cu_6Sn_5$) is in a range of 10 to 60%; a fraction in a crystal direction of <123>||[001] of the Sn or Sn alloy layer is in a range of 10 to 60%; and a fraction in a crystal direction of <014>||[001] of the Sn or Sn alloy layer is lower than or equal to 10%. In one embodiment, the method may further include plating a nickel or nickel alloy layer before or after the (b) step. In one embodiment, in an XRD analysis of the nickel plate layer shows that a ratio between intensities I in {002} and {111} crystal planes satisfies $1.25<I\{002\}/I\{111\}<2$, and a ratio between intensities I in {002} and {022} crystal planes satisfies $10<I\{002\}/I\{022\}$. In one embodiment, the surface-treatment agent is at least one pair selected from pair group consisting of a pair of phosphoric acid and phosphoric acid ester, a pair of phosphorous acid and phosphorous acid ester, and a pair of hypophosphoric acid and hypophosphoric acid ester, and a concentration of the surface-treatment agent is in a range of 2 to 10 g/mL. In one embodiment, a carbon (C), phosphorus (P), and oxygen (O) compound is present on a surface of the tin or tin alloy plated layer, and a relation between C, P, and O is $0.5<(C+P)/O<2.5$. In one embodiment, a thickness of the underlying plated layer is in a range of 0.1 to 2.0 μm, and the underlying plated layer includes the copper plating. Alternatively, in one embodiment, a thickness of the underlying plated layer may be in a range of 0.1 to 2.0 μm, and the underlying plated layer may include the copper plating and the nickel plating. In one embodiment, a thickness of the tin-plated layer is in a range of 0.2 to 3.0 μm, a thickness of the Cu—Sn compound after the reflow-treatment is in a range of 0.1 to 1.5 μm, and a thickness of tin is in a range of 0.1 to 1.5 μm. In one embodiment, the tin-plated layer includes at least one selected from a group consisting of Sn, Sn—Ag, Sn—Bi, Sn—Zn, Sn—Pb or combinations thereof. In one embodiment, the nickel-plated layer includes at least one selected from a group consisting of Ni, Ni—Pd, Ni—Co, Ni—Sn, Ni—P or combinations thereof.

Further, the instant disclosure provides a tin-plating material for the copper alloy for an electric or electronic part or automobile part manufactured based on the above-mentioned method for manufacturing the tin-plating material for the copper alloy for an electric or electronic part or automobile part.

The instant disclosure may provide a method for plating tin on a copper alloy for an electric or electronic part or automobile part, and a tin-plating material for the copper alloy manufactured therefrom. The tin-plating material reduces an insertion force, and has excellent heat-resistant peeling property and solderability. Further, a manufacturing cost of the tin plating of the copper alloy may be reduced through the above method.

BRIEF DESCRIPTION OF DRAWINGS

FIG. 1 respectively shows a measurement result using an EBSD of a fraction in a crystal direction of <2-1-10>||[001] of a Cu—Sn compound ($Cu_6Sn_5$) existing on a section of a tin-plated layer on a copper alloy according to Example 4, and measurement results using an EBSD of a fraction in a crystal plane of <123>||[001] and a fraction in a crystal direction of <014>||[001] of a Sn layer existing on a section of a tin-plated layer on a copper alloy according to Example 4.

FIG. 2 is a schematic diagram of a friction coefficient measuring equipment.

DETAILED DESCRIPTIONS

The instant disclosure relates to a method for plating tin on a copper alloy containing copper, and to a tin-plating material for the copper alloy manufactured therefrom.

Herein, unless otherwise defined, the terms "copper alloy" and "copper alloy material" are interchangeable, and are meant to include pure copper for convenience.

Further, herein, unless otherwise defined, a specific "metal plated layer" or a "metal layer" are interchangeable, and are meant to include a plated layer of a corresponding metal and an alloy thereof, for convenience.

According to the instant disclosure, a base material to-be-tin-plated include various kinds of copper alloys such as pure copper, phosphor bronze (Cu—Sn—P), brass (Cu—Zn), Corson-based alloy (Cu—Ni—Si), Cu—Fe—P-based alloy, nickel silver (Cu—Ni—Zn), cupronickel (Cu—Ni), and the like. The base material is usually provided in a form of a plate, but may be provided in a form of a rod or a tube when it is necessary.

A method for plating tin on a copper alloy according to the instant disclosure includes (a) electrolytic-degreasing and pickling a copper alloy base material; (b) plating an underlying copper layer on the copper alloy base material; (c) plating a tin or tin alloy layer on the underlying copper layer; (d) surface-treating the tin or tin alloy layer by mist-spraying a surface-treatment agent thereon to form a product; and (e) reflow-treating the product, wherein the reflow-treatment includes performing a first heat treating of the product at a temperature of 200 to 250° C. for 1 to 30 seconds, then a second heat treating of the product at a temperature of 300 to 700° C. for 3 to 1200 seconds. Before or after the (b) step, plating a nickel or nickel alloy layer may be added. Further, cleaning with pure water may be added before and after each step.

Specifically, the step (a) of the electrolytic-degreasing and the pickling of a copper alloy base material is for removing contaminants such as an oxide and oil on the copper or copper alloy base material. The electrolytic-degreasing may be performed, for example, with an electrolytic-degreasing agent (e.g., UDC-5030L) diluted with water at a concentration of approximately 50 to 120 g/L. The pickling is for removing contaminants such as hydroxide and oxide that has not been removed in the electrolytic-degreasing, with acidified aqueous solution. The pickling may be performed, for example, with concentrated sulfuric acid that is sulfuric acid diluted with water. Those skilled in the art may utilize known technologies in the electrolytic-degreasing and the pickling.

The step (b) of the plating of the underlying copper layer increases an adhesion and a smoothness of a base material surface, thereby preventing defects such as a poor gloss, a coarse plating, and a plating peeling of the copper alloy obtained in the previous step. For example, the plating of the underlying copper layer may be performed with a copper underlying layer plating solution constituted by $CuSO_4$ (copper sulphate) 140 to 180 g/L and $H_2SO_4$ (sulfuric acid) 80 to 120 g/L, under a condition of a time of 20 to 500 seconds, a temperature of 30 to 60° C., and a current of 1 to 10 ASD. When the copper sulphate ($CuSO_4$) is too insufficient in the copper underlying layer plating solution, the copper plated layer is not uniformly formed on the base material surface. Therefore, in the formation of the tin-plated layer, which is a subsequent step, a gloss and a throwing power of the tin plating may be lowered such that a plating defect such as a local coarse plating, and the like is likely to occur. Further, when an amount of the copper sulphate is too excessive, a current density increases due to a high sulfuric acid concentration, resulting in a crystallization of the copper sulphate.

In one example, in order to improve a heat resistance, nickel plating may be performed before or after the step (b)

of the copper plating as necessary. In this connection, the nickel plating may mean a nickel or nickel alloy plating. For example, a nickel-plating solution may be constituted by 700 to 800 g/L of nickel sulfamate, 3 to 10 g/L of nickel chloride, 30 to 60 g/L of boric acid, and 5 to 20 ml/L of polish-based additive. The polish-based additive may be selected from organic polishes having a formula of —C—$SO_2$—, including naphthalene or dinitrobenzene sulfonic acid (DNS).

Further, the nickel/nickel alloy plating may be performed at a temperature of 40 to 60° C., a current of 2 to 7 ASD, and a time of 10 to 1000 seconds. The nickel layer forming an underlying plated layer may include Ni, Ni—Pb alloy, Ni—Co alloy, Ni—Sn alloy, or Ni—P alloy. In the nickel plating, when the current is below 2 ASD or the time is less than 10 seconds, a friction force increases due to a crystal orientation of the under nickel such that an insertion force increases on the contrary. Further, when the current exceeds 7 ASD or the time exceeds 1000 seconds, a brittleness of the plated layer occurs due to an increase of a stress in the plated layer of Ni.

In an XRD analysis, in crystal planes {111}, {002}, and {022}, the nickel plated layer introduced as described above satisfies a ratio between intensities I of $1.25<I\{002\}/I\{111\}<2$ in the crystal planes {002} and {111}, and a ratio between intensities I of $10<I\{002\}/I\{022\}$ in the crystal planes {002}, {022} at the same time. The crystal orientation of the underlying nickel layer is described in more detail below.

Subsequently, the step (c) of the tin or tin alloy plating is important for increasing a corrosion resistance and improving a solderability. A tin plating solution may be prepared using a technology known in the art. For example, 100 to 200 ml/L of stannous methane sulfonate, which is an organic acid, 100 to 200 ml/L of methane sulfonic acid, which is an organic acid, and 50 to 150 ml/L of volatile additive containing alcohol may be mixed together, and prepared as the tin plating solution. The volatile additive containing the alcohol is a mixture of volatile alcohol and at least one selected from a group consisting of seleous acid, sodium selenite, sodium arsenite, potassium thiocyanate, lead carbonate, and zinc. The additive also enables to obtain a microstructure refinement and a smoothness. The tin plating may be performed, for example, under a condition of a temperature of 40 to 60° C., a current of 1 to 10 ASD, and a time of 10 to 1000 seconds. The tin-plated layer may be selected from Sn, Sn—Ag alloy, Sn—Bi alloy, Sn—Zn alloy, or Sn—Pb alloy.

Subsequently, in the step (d), the surface-treatment of product obtained in the previous step is performed. A phosphate-based organic surface-treatment agent is used as a surface-treatment agent. At least one pair may be selected as the surface-treatment agent from a mixed solution of phosphoric acid and phosphoric acid ester, a mixed solution of phosphorous acid and phosphorous acid ester, or a mixed solution of hypophosphoric acid and hypophosphoric acid ester. A mixing ratio of the acid and the ester may be, for example, 1:2. The surface-treatment may be performed in a mist method by diluting the surface-treatment agent in an aqueous solution by 2 to 10 g/ml.

The phosphate-based organic surface-treatment agent is uniformly distributed on the Sn plating, thereby increasing the smoothness of the tin plating and reducing the insertion force.

A concentration of the surface-treatment agent is 2 to 10 g/ml. When the surface-treatment agent is treated at a concentration of below 2 g/ml, an oxide film on the plated layer surface is not formed sufficiently. Thus, a friction coefficient increases, and the insertion force of the tin-plating material decreases, and a ratio (C+P)/O in a carbon (C), phosphorus (P), and oxygen (O) compound (C, P and O compound) to be described below is lowered than 0.5. When the concentration of the surface-treatment agent exceeds 10 g/ml, a stain is formed. Thus, the friction coefficient increases, the solderability decreases, and the ratio (C+P)/O in a carbon (C), phosphorus (P), and oxygen (O) compound (C, P, and O compound) to be described below exceeds 2.5.

In this regard, in general, the insertion force required for an electric or electronic part or automobile part may be represented as the friction coefficient of the material plated layer. Further, it is known that the friction coefficient should be below 0.4. The insertion force to be achieved by the instant disclosure corresponds to 0.1 to 0.4 of the friction coefficient. Within the above range, not only the friction coefficient, which is a main characteristic of the plated layer, but also the heat-resistant peeling property and the solderability are satisfied at the same time. A characteristic that the tin-plated layer may be applied as a terminal material may be retained. When the friction coefficient is lower than 0.1 of the above range, after the surface-treatment and the two-step reflow-treatment, a fraction of a Cu—Sn intermetallic compound increases. Thus, the friction coefficient is low, but the heat-resistant peeling property and the solderability are bad. In addition, when the friction coefficient is higher than 0.4, a fraction of the Sn layer increases. Thus, the heat-resistant peeling property and the solderability are good, but the friction coefficient is high.

In regard of the solderability, when a wetting time is less than 3 seconds, a material may be preferably used for an electric or electronic part or automobile part in general. The wetting time wanted to be reached in the tin-plating material of the copper alloy according to the instant disclosure ranges from 0.1 to 3 seconds. Within the above range, a fraction of Sn and a fraction of Sn—Cu intermetallic compound are adjusted to an optimum condition such that a solderability, which may be applied to the terminal material, is realized. At the same time, a friction coefficient advantageous for a low insertion force may be obtained. When the wetting time is less than 0.1 second, the solderability is good due to a high fraction of Sn, but the friction coefficient is high due to a low fraction of the rigid Sn—Cu intermetallic compound. When the wetting time is more than 3 seconds, the friction coefficient is low due to a high fraction of the rigid Sn—Cu intermetallic compound, but the solderability is bad.

In the instant disclosure, the surface-treatment employs the mist method. Generally, dipping and spraying methods have been employed for the surface-treatment in the past. The dipping method includes squeezing a product after passing the same through a solution, which causes a stain on a product surface because water on the surface is not completely removed. In the spraying method, a spray does not uniformly spray the surface-treatment agent onto the plating surface. Further, both methods have a disadvantage of low productivity and high manufacturing costs due to a recycling problem of a surface-treatment agent tank and a contamination of the surface-treatment agent during processing. In the instant disclosure, the mist method is employed, instead of the existing dipping method or spraying method. In the mist method, the surface-treatment agent and air are mixed, and jetted through a nozzle. Fine particles may be uniformly jetted on the tin plating surface in a very small amount, thereby preventing the surface stain due to a flow of the surface-treatment agent. Further, a surface-treatment agent consumption is low, the surface-treatment agent tank is not contaminated, and a replacement of the surface-treatment agent tank is drastically reduced, thereby reducing the manufacturing cost. The surface-treatment described above is followed by the two-step reflow-treatment, therefore no additional heat treatment is required.

Subsequently, in the step (e), the product obtained in the previous step is reflow-treated in two steps. The first heat treatment is performed at 200 to 250° C. for 1 to 30 seconds, and the second heat treatment is performed at 300 to 700° C. for 3 to 1200 seconds. The first step heat treatment stabilizes the formation of the carbon (C), phosphorus (P), and oxygen (O) compound on the tin surface, and at the same time promotes a growth of a Cu—Sn compound ($Cu_6Sn_5$) in a crystal direction of <2-1-10>||[001]. The second heat treatment grows the Sn plated layer in a crystal direction of <123>||[001], and suppresses a growth in a crystal direction of <014>||[001].

In the two-step reflow-treatment, when the first heat treatment is performed at below 200° C. and less than 1 second, or when the second heat treatment is performed at below 300° C. and less than 3 seconds, a fraction in a crystal direction of <2-1-10>||[001] of the obtained Cu—Sn compound ($Cu_6Sn_5$) becomes lower than or equal to 10%, a fraction in a crystal direction of <123>||[001] of the tin-plated layer becomes lower than or equal to 10%, and a fraction in a crystal direction of <014>||[001] of the tin-plated layer exceeds 10%. Thus, a friction coefficient of a final obtained tin-plating material increases. In the reflow-treatment, when the first heat treatment is performed at above 250° C. and more than 30 seconds, or when the second heat treatment is performed at above 700° C. and more than 1200 seconds, when a fraction of the Cu—Sn compound ($Cu_6Sn_5$) exceeds 60%, and a fraction in a crystal direction of <123>||[001] of the tin alloy layer exceeds 60%, the heat-resistant peeling property is improved.

When an one-step reflow-treatment after the surface-treatment is compared with the two-step-reflow-treatment, the fraction in the crystal direction of <2-1-10>||[001] of the Cu—Sn compound ($Cu_6Sn_5$) becomes lower than or equal to 10%. Further, in the formation of the carbon (C), phosphorus (P), and oxygen (O) compound, an amount of carbon (C) increases to form an unstable compound. Thus, the relation (C+P)/O exceeds 2.5. Thus, the surface stain occurs, and the friction coefficient increases.

In the reflow step (e), through the two-step reflow heat treatment described above, a growth of the underlying copper layer or the underlying plated layer, which is the combination of the underlying copper layer and the underlying nickel alloy plated layer; and a growth the Cu—Sn compound ($Cu_6Sn_5$) on the tin-plated layer in crystal directions are promoted. At the same time, a phosphate-based carbon (C), phosphorus (P), and oxygen (O) compound is formed. More specifically, after the reflow of the surface, the compound having a lubricity is formed on the surface in an oxide form by reacting with the Sn plated layer. As a result of the compound element analysis of the compound with the FE-SEM/EDS, there are carbon, phosphorus, and oxygen elements. Due to the lubricity of the compound, the insertion force, the heat-resistant peeling property, and the solderability of the finally tin-plating material of the copper alloy may be secured at the same time.

In this connection, a content of carbon (C), phosphorus (P), and oxygen (O) in the compound satisfies a relation of 0.5<(C+P)/O<2.5. When a (C+P)/O value of the compound is 2.5 or above, the solderability of the surface is reduced. Further, when the (C+P)/O value is 0.5 or below, the insertion force drops.

Recently, two methods have been used to reduce the friction coefficient. A first method is to reduce the insertion force by exposing the Cu—Sn compound or the Cu—Sn—Ni compound produced during the plating of the tin-plated layer through the one-step reflow-treatment after the tin plating. In this case, an area ratio of the tin layer is relatively low such that the heat-resistant peeling property and the solderability of the tin layer become poor. A second method is to perform an after treatment such as an Ag plating after the heat treatment of the tin plating. In this case, the Ag plating is performed as a process for improving poor physical properties such as the heat resistance. Therefore, a cost increases due to an addition of a manufacturing process and a raw material of Ag.

In the copper alloy tin plating method according to the instant disclosure, after the tin plating, the surface-treatment agent was uniformly jetted on the surface in the mist method. Then the Cu—Sn compound layer ($Cu_6Sn_5$) is formed through the two-step reflow-treatment, and the crystal structure of the Sn layer is controlled. Therefore, the friction coefficient of the tin plating surface is reduced. This allows the copper alloy tin-plating material with excellent solderability, heat-resistant peeling property, and surface gloss to be obtained. Further, comparing with the existing methods, the method according to the instant disclosure may prevent the surface-treatment agent from being contaminated secondarily, and perform the reflow-treatment without additional heat treatment after the surface-treatment, thereby reducing the manufacturing cost.

The tin-plating material of the copper alloy produced according to the tin-plating method described above has following characteristics.

1. Fractions in Crystal Direction of the Tin-Plated Layer of the Copper Alloy

On the surface of the tin-plating material of the copper alloy plated according to the above method, a fraction in a crystal direction of <2-1-10>||[001] of the Cu—Sn compound ($Cu_6Sn_5$) is 10 to 60%. Further, a fraction in a crystal direction of <123>||[001] of the Sn layer is 10 to 60%, and a fraction in a crystal direction of <014>||[001] of the Sn layer is 10% or below. When the above three conditions are satisfied, the insertion force, the heat-resistant peeling property, and the solderability are all excellent at the same time. It is considered that not only the shape of the tin-plated layer surface but also the fraction increase in a crystal direction of <2-1-10>||[001] of the Cu—Sn compound ($Cu_6Sn_5$) layer of the tin-plated layer and the fraction increase in a crystal direction of <123>||[001] of the Sn layer in an insertion process of the terminal reduce a stress concentration and the friction coefficient to reduce the insertion force. Further, the crystal direction of <014>||[001] is opposite to and is against a growth arrangement in the crystal direction of <123>||[001]. The insertion force tends to decrease within a range where a fraction in the crystal direction of <014>||[001] of the Sn layer exceeds 10%.

2. Compound Generated after the Surface-Treatment and the Reflow

In the instant disclosure, the surface-treatment and the reflow-treatment generate the compound with the lubricity on the tin-plating material surface of the copper alloy. As a result of the compound element analysis of the compound with the FE-SEM/EDS, there are C, P, and O elements. In this connection, the relation 0.5<(C+P)/O<2.5 is maintained. Within the above range, the compound does not affect the heat-resistant peeling property and the solderability of the plating material, and a surface energy decreases during the terminal insertion. Therefore, the insertion force is reduced.

3. Crystal Orientation of the Underlying Nickel Layer

After a selective underlying nickel layer, as a result of the XRD analysis of the plating material, crystal orientation of the nickel-plated layer based on an intensity at peaks may be represented as diffraction intensity values. In the instant disclosure, crystal planes for the XRD analysis after the nickel plating are {111}, {002}, and {022} planes. In the nickel plating of the instant disclosure described above, when the ratio between intensities I in the crystal planes {002} and {111} satisfies $1.25<I\{002\}/I\{111\}<2$, and the ratio between intensities I in the crystal planes {002}, {022} satisfies $10<I\{002\}/I\{022\}$ at the same time, the friction coefficient, the heat-resistant peeling property, and the solderability are good. That is, in order to reduce the frictional force, not only the surface-treatment and a control of the tin layer crystal plane, but also a control of the crystal plane of the underlying nickel or nickel alloy plated layer is important.

4. Thickness of the Underlying Plated Layer

Before performing the tin plating, the underlying copper layer is performed to improve adhesion and smoothness. When the underlying plated layer is not performed, various defects such as poor gloss, coarse plating, and plating peeling may occur. In the instant disclosure, the copper plating is performed as the underlying plated layer on the surface of the copper and the copper alloy materials. In addition, the nickel or nickel alloy plating may be selectively performed before or after the copper plating.

When only the copper plating is performed, a sum of a total underlying plated layer thickness is in a range of 0.1 to 2.0 μm. When the thickness is below 0.1 μm, the heat-resistant peeling property decreases due to a diffusion of an element of the base material. When the thickness is above 2.0 μm, the Cu—Sn intermetallic compounds are not generated sufficiently, resulting in a friction coefficient decrease.

Further, even when the nickel or nickel alloy plating is added, the sum of the total underlying plated layer thickness is in a range of 0.1 to 2.0 μm. Even though the nickel or underlying nickel alloy plated layer is included on or under the underlying copper layer, the total underlying plated layer thickness is equally in the range of 0.1 to 2.0 μm. When the total underlying plated layer thickness is below 0.1 μm, it is difficult to suppress the diffusion of the Cu—Sn intermetallic compound from the copper material surface to the tin-plated layer in a high temperature environment. Thus, the heat-resistant peeling property drops. Further, when the underlying plated layer thickness above 2.0 μm, the Cu—Sn intermetallic compounds are not generated sufficiently in the two-step reflow-treatment, which is the after treatment. Therefore, the friction coefficient drops. When the underlying nickel layer exists, a ratio between the underlying copper layer and the underlying nickel layer may be arbitrarily adjusted by those skilled in the art as long as the same are produced within an entire thickness range.

When the total underlying plated layer thickness is below 0.1 μm, the heat-resistant peeling property drops due to the diffusion of the element of the base material. In addition, even though the total underlying plated layer thickness is above 2.0 μm, the friction coefficient drops because the Cu—Sn intermetallic compounds of the tin-plated layer are not generated sufficiently.

5. Thickness of the Tin-Plated Layer

According to the instant disclosure, the tin-plated layer is formed on the underlying plated layer. A total thickness of the tin-plated layer is in a range of 0.2 to 3.0 μm. After the above surface-treatment and reflow-treatment, a thickness of the plating of the Cu—Sn compound is in a range of 0.1 to 1.5 μm, and a thickness of the tin is in a range of 0.1 to 1.5 μm. When the thickness of the plated layer of the Cu—Sn compound is below 0.1 μm, a frictional force of the tin plating surface increases, and the thickness is above 1.5 μm, the solderability decreases. Further, when the thickness of the tin is below 0.1 μm, the solderability decreases, and when the thickness is above 1.5 μm, a frictional force of the tin plating surface increases to reduce the insertion force.

EXAMPLES

Example 1

The copper alloy base material of the Corson-based alloy (Cu—Ni—Si) was cut into a size of 10 cm×10 cm. The sample was electrolytically degreased with the UDC-5030L, the electrolytic-degreasing agent, of a concentration of 70 g/L, and then pickled with the concentrated sulfuric acid of 10% concentration for 10 seconds ((a) electrolytic-degreasing and pickling steps).

Subsequently, the underlying copper layer plating solution constituted by 160 g/L of $CuSO_4$ (copper sulphate) and 100 g/L of $H_2SO_4$ (sulfuric acid) was prepared. The underlying copper layer was performed for 60 seconds at a plating bath temperature of 40° C. and a current of 2 ASD, and a thickness of the resulting copper plating was 0.3 μm ((b) copper plating step).

Thereafter, the tin plating was performed with the tin plating solution containing 150 ml/L of stannous methane sulfonate, which is an organic acid, 150 ml/L of methane sulfonic acid, which is an organic acid, and 80 ml/L of the additive, which is a mixture of seleous acid, sodium selenite, potassium thiocyanate, and methanol at a ratio of 1:1:2:5 and the volatile alcohol. The tin plating was performed for 60 seconds at a temperature of 30° C. and a current of 2 ASD. As a result, the tin-plated layer of 0.4 μm was formed ((c) tin plating step).

Subsequently, a mixed solution of phosphoric acid and phosphoric acid ester in a ratio of 1:2 was mixed with an aqueous solution of 5 g/ml to form a surface-treatment agent. Then, the product obtained in the operation (C) was surface-treated with the surface-treatment agent in the mist method ((d) surface-treatment step).

In the reflow-treatment, the first heat treatment was performed at 250° C. for 3 seconds and the second heat treatment was performed at 550° C. for 15 seconds ((e) reflow step).

A final obtained sample was referred to as an Invention Example 1.

Example 2

Except for an addition of nickel plating before the underlying copper layer described in Example 1, the tin-plating material was produced in the same manner as Invention Example 1 to acquire a sample, which is referred to as Example 2. The nickel plating was performed using a nickel-plating solution prepared with 750 g/L of nickel sulfamate, 5 g/L of nickel chloride, 40 g/L of boric acid, and 10 ml/L of ICN-600H (INCHON CHEMICAL INC. (Incheon, Korea)), which is an organic polish. Further, the nickel plating was performed in a condition of a temperature of 55° C., a current of 3 ASD, and a plating time of 40 seconds.

Examples 3 to 14

With reference to Example 1 or Example 2, Examples 3 to 14 were performed based on detailed manufacturing conditions described in Table 1 and Table 2. Samples were obtained based on Examples 3 to 14, respectively, and are respectively named Invention Examples 3 to 14.

Comparative Examples 1 to 14

In a manner analogous to the Examples described above, samples were prepared under the conditions described in Table 1 and Table 2, respectively, and are respectively named as Comparative Examples 1 to 14.

TABLE 1

| | | Underlying layer | | | | | | Tin or tin alloy plating | |
|---|---|---|---|---|---|---|---|---|---|
| | | Plating order | | | Total underlying layer thickness | Tin or tin alloy plating (before reflow-treatment) | | Tin or tin alloy plating (after surface-treatment and reflow-treatment) | |
| No. | | Copper | Nickel or nickel alloy | Copper | (μm) | Type | Thickness (μm) | Cu—Sn compound (μm) | Tin (μm) |
| Invention Example | 1 | absent | absent | Cu | 0.3 | Sn | 0.4 | 0.32 | 0.08 |
| | 2 | absent | Ni | Cu | 0.35 | Sn | 0.6 | 0.42 | 0.18 |
| | 3 | absent | absent | Cu | 0.3 | Sn—Ag | 0.8 | 0.53 | 0.27 |
| | 4 | absent | absent | Cu | 0.3 | Sn | 1.0 | 0.82 | 0.18 |
| | 5 | absent | absent | Cu | 0.3 | Sn | 1.2 | 0.85 | 0.35 |
| | 6 | absent | Ni—Co | Cu | 0.4 | Sn—Bi | 0.4 | 0.35 | 0.05 |
| | 7 | absent | Ni | Cu | 0.3 | Sn | 0.6 | 0.42 | 0.18 |
| | 8 | absent | Ni | Cu | 0.3 | Sn | 0.8 | 0.65 | 0.15 |
| | 9 | absent | Ni—P | Cu | 0.4 | Sn | 1.2 | 0.82 | 0.38 |
| | 10 | absent | Ni | Cu | 0.3 | Sn | 1.0 | 0.83 | 0.17 |
| | 11 | Cu | Ni | absent | 0.5 | Sn—Bi | 0.8 | 0.75 | 0.05 |
| | 12 | Cu | Ni—P | absent | 0.4 | Sn | 1.0 | 0.82 | 0.18 |
| | 13 | Cu | Ni | absent | 0.3 | Sn—Ag | 1.0 | 0.85 | 0.15 |
| | 14 | Cu | Ni—Co | absent | 0.3 | Sn | 1.2 | 0.82 | 0.38 |
| Comparative Example | 1 | absent | Ni | Cu | 0.3 | Sn | 0.8 | 0.62 | 0.18 |
| | 2 | Cu | Ni | absent | 0.3 | Sn | 1.0 | 0.85 | 0.15 |
| | 3 | absent | absent | Cu | 0.3 | Sn | 0.8 | 0.23 | 0.57 |
| | 4 | absent | Ni—P | Cu | 0.3 | Sn | 1.0 | 0.95 | 0.05 |
| | 5 | absent | absent | Cu | 0.3 | Sn—Ag | 4.0 | 0.86 | 3.1 |
| | 6 | Cu | Ni | absent | 0.3 | Sn | 0.05 | 0.15 | 0.05 |
| | 7 | absent | absent | Cu | 0.3 | Sn | 1.0 | 0.81 | 0.19 |
| | 8 | absent | Ni | Cu | 0.3 | Sn | 1.0 | 0.85 | 0.15 |
| | 9 | absent | absent | Cu | 0.3 | Sn | 0.8 | 0.57 | 0.23 |
| | 10 | absent | Ni | Cu | 0.3 | Sn | 0.8 | 0.58 | 0.22 |
| | 11 | absent | Ni | Cu | 0.3 | Sn | 1.0 | 0.82 | 0.18 |
| | 12 | absent | absent | Cu | 0.3 | Sn | 1.0 | 0.81 | 0.19 |
| | 13 | absent | Ni | Cu | 0.3 | Sn | 1.0 | 0.83 | 0.17 |
| | 14 | absent | Ni | Cu | 0.3 | Sn | 1.0 | 0.80 | 0.20 |

TABLE 2

| | | Surface-treatment (phosphoric acid + phosphoric acid ester) | | Reflow condition | | | |
|---|---|---|---|---|---|---|---|
| | | | Surface-treatment agent | First heat treatment | | Second heat treatment | |
| No. | | Method | concentration (g/ml) | Temperature (° C.) | Time (second) | Temperature (° C.) | Time (second) |
| Invention Example | 1 | mist | 5 | 250 | 3 | 550 | 15 |
| | 2 | mist | 5 | 250 | 3 | 550 | 15 |
| | 3 | mist | 5 | 250 | 3 | 500 | 15 |
| | 4 | mist | 5 | 250 | 3 | 550 | 10 |
| | 5 | mist | 10 | 250 | 3 | 500 | 15 |
| | 6 | mist | 5 | 250 | 3 | 550 | 15 |
| | 7 | mist | 7 | 250 | 3 | 550 | 15 |
| | 8 | mist | 7 | 250 | 3 | 550 | 15 |
| | 9 | mist | 5 | 250 | 3 | 550 | 15 |
| | 10 | mist | 7 | 250 | 3 | 600 | 10 |
| | 11 | mist | 5 | 250 | 3 | 600 | 15 |

TABLE 2-continued

| No. | | Surface-treatment (phosphoric acid + phosphoric acid ester) Method | Surface-treatment agent concentration (g/ml) | Reflow condition First heat treatment Temperature (° C.) | First heat treatment Time (second) | Second heat treatment Temperature (° C.) | Second heat treatment Time (second) |
|---|---|---|---|---|---|---|---|
| | 12 | mist | 7 | 250 | 3 | 650 | 20 |
| | 13 | mist | 7 | 250 | 3 | 600 | 15 |
| | 14 | mist | 5 | 250 | 3 | 550 | 20 |
| Comparative Example | 1 | mist | 1 | 250 | 3 | 550 | 8 |
| | 2 | mist | 50 | 250 | 3 | 550 | 8 |
| | 3 | mist | 7 | 100 | 1 | 350 | 2 |
| | 4 | mist | 7 | 300 | 35 | 800 | 1500 |
| | 5 | mist | 7 | 250 | 3 | 550 | 8 |
| | 6 | mist | 7 | 250 | 3 | 550 | 8 |
| | 7 | dipping | 7 | 250 | 3 | 550 | 15 |
| | 8 | dipping | 7 | 250 | 3 | 550 | 15 |
| | 9 | spray | 7 | 250 | 3 | 550 | 15 |
| | 10 | spray | 7 | 250 | 3 | 550 | 15 |
| | 11 | mist | 7 | — | — | 550 | 15 |
| | 12 | mist | 7 | — | — | 550 | 15 |
| | 13 | mist | 7 | 250 | 3 | 550 | 15 |
| | 14 | mist | 7 | 250 | 3 | 550 | 15 |

Experimental Example

Following evaluations were performed for each of the samples obtained according to the Examples and Comparative Examples. Fraction measurements of the Cu—Sn compound ($Cu_6Sn_5$) and the Sn layer in crystal directions, friction coefficient measurements, measurements of the heat-resistant peeling property, the solderability, and the plating thickness, surface element analyses, and XRD analyses for each of the samples were evaluated by following methods.

(1) Measurement of Fractions in Crystal Directions of the Cu—Sn Compound ($Cu_6Sn_5$) and the Sn Layer End faces of the obtained samples were polished by an ion milling. Then, the obtained samples were measured using an FE-SEM EBSE equipment. Then, the fractions in crystal directions were analyzed using a TSL OIM analyzer. Crystal plane fractions were calculated by measuring directions from the EBSD results. Results were shown in Table 3.

(2) Measurement of Friction Coefficient

The friction coefficient is an indicator of the insertion force. The friction coefficients were measured using a friction coefficient measuring equipment Triboger Type: 14FW (manufacturer: HEIDON, Tokyo, Japan). Plate samples of the Sn-plating materials were fixed on a sample stage. A contactor of a plated face was φ10 mm stainless ball, and a weight was 30 g. A moving speed of the sample stage was 13 mm/sec, and a moving distance was 10 mm. An equation of the friction coefficient was calculated as $\mu=F/W$. Results were shown in Table 3. In the samples according to the instant disclosure, the friction coefficients are in a range of 0.1 to 0.4.

(3) Heat-Resistant Peeling Property

The heat-resistant peeling properties were determined by a following method. The obtained samples were cut into a length of 60 mm and a width of 10 mm, and heated at 180° C. for 1 hour. Then, the samples were taken out, and cooled. Then, the samples were bent at 90°, and unfolded again. Adhesive tapes (3M Masking Tape, #851A) were adhered to inner sides of the bending portions of the samples. Then, the adhesive tapes were removed from the samples, and the inner sides of the bending portions were observed with an optical microscope. When there is no peeling mark on a plating surface, a sample is determined as 'good'. In addition, when a plating surface is peeled, a sample is determined as 'peeled'. Results were shown in Table 3.

(4) Solderability of the Tin-Plating Material

The samples were suspended in a balancing system (typically a spring system), and ends of the samples were dipped to a predetermined depth in a molten solder bath at 235±5° C. A combined force in a vertical direction of a buoyancy and a surface tension applied to the dipped samples was detected using a transformer, and recorded continuously on a high-speed chart recorder in a function based on time. Contact angles between material surfaces and solders and weights of the samples were measured to measure the solderability (wetting time, second). Obtained results were shown in Table 3.

(5) Measurement of Plating Thickness

A primary X-ray generated from an X-ray tube is irradiated on the sample surface to generate a secondary fluorescent X-ray. Intensity of the secondary fluorescence X-ray generated from the surface of the material increases or decreases in proportion to a plated thickness on the surface. This process was calculated as a correlation between the plating thickness and the intensity of the secondary fluorescence X-ray. The thickness of the plated layer was measured five times to obtain an average value. Table 1 shows respective plating thicknesses of the underlying copper layer, the underlying nickel layer, and the tin-plated layer.

(6) Surface Element Analysis of the Tin-Plate Layer

Surfaces of the samples, which were surface-treated and reflow-treated, were subjected to the ion milling, and analyzed by the FE-SEM/EDS. Results were shown in Table 3.

(7) XRD Analysis of a Crystal Structure of the Nickel Plate Layer

The samples were cut into 1 cm×1 cm. Then, the crystal structures of the nickel-plated layers were analyzed by the XRD. Then, intensity ratios of major peaks were calculated using a High Score Plus device (manufacturer: Panalytical, Netherlands). Results were shown in Table 4.

(8) Whether a Surface Stain Occurs

The samples were cut into 5 cm×5 cm, and whether the stains occur on the sample surfaces were observed via the optical microscope. Upon a visual observation, when the stain does not exist, the sample is determined as 'absent', and when the stain exists, the sample is determined as 'present'. Results were shown in Table 3.

TABLE 3

| No. | | Cu—Sn compound ($Cu_6Sn_5$) crystal plane fraction <2-1-10>‖[001] | Tin, tin alloy crystal plane fraction <123>‖[001] | <014>‖[001] | Friction coefficient | Heat-resistant peeling property | Stain | Solderability (wetting time, second) | Phosphate relation (C + P)/O |
|---|---|---|---|---|---|---|---|---|---|
| Invention Example | 1 | 28 | 36 | 6 | 0.32 | good | absent | 2.85 | 1.8 |
| | 2 | 33 | 35 | 5 | 0.25 | good | absent | 2.27 | 2.2 |
| | 3 | 33 | 41 | 5 | 0.21 | good | absent | 1.15 | 2.4 |
| | 4 | 28 | 36 | 5 | 0.35 | good | absent | 0.65 | 1.6 |
| | 5 | 25 | 35 | 4 | 0.33 | good | absent | 2.75 | 2.3 |
| | 6 | 32 | 38 | 7 | 0.18 | good | absent | 0.72 | 2.3 |
| | 7 | 35 | 37 | 5 | 0.25 | good | absent | 1.25 | 2.3 |
| | 8 | 32 | 43 | 3 | 0.23 | good | absent | 1.16 | 2.8 |
| | 9 | 35 | 42 | 4 | 0.27 | good | absent | 0.85 | 2.4 |
| | 10 | 38 | 40 | 3 | 0.28 | good | absent | 1.34 | 2.2 |
| | 11 | 34 | 38 | 3 | 0.28 | good | absent | 0.75 | 2.1 |
| | 12 | 37 | 41 | 4 | 0.29 | good | absent | 0.78 | 2.3 |
| | 13 | 35 | 42 | 5 | 0.25 | good | absent | 0.92 | 1.9 |
| | 14 | 36 | 41 | 5 | 0.23 | good | absent | 0.87 | 2.2 |
| Comparative Example | 1 | 35 | 38 | 5 | 0.46 | good | absent | 2.25 | 0.3 |
| | 2 | 32 | 35 | 7 | 0.22 | good | present | 4.52 | 3.2 |
| | 3 | 4 | 5 | 18 | 0.53 | good | absent | 0.85 | 2.2 |
| | 4 | 73 | 68 | 2 | 0.19 | peeling | absent | 5.21 | 1.6 |
| | 5 | 8 | 9 | 15 | 0.43 | good | absent | 0.57 | 2.3 |
| | 6 | 68 | 72 | 3 | 0.28 | peeling | absent | 0.53 | 2.2 |
| | 7 | 33 | 41 | 5 | 0.39 | good | present | 4.35 | 3.1 |
| | 8 | 31 | 42 | 4 | 0.41 | good | present | 4.11 | 3.2 |
| | 9 | 32 | 38 | 6 | 0.42 | good | present | 3.23 | 2.8 |
| | 10 | 31 | 37 | 6 | 0.39 | good | present | 3.21 | 2.9 |
| | 11 | 8 | 35 | 5 | 0.43 | good | present | 1.15 | 3.0 |
| | 12 | 7 | 36 | 6 | 0.42 | good | present | 0.98 | 3.1 |
| | 13 | 35 | 41 | 3 | 0.42 | good | absent | 1.25 | 1.8 |
| | 14 | 36 | 40 | 4 | 0.29 | bad | absent | 1.25 | 1.5 |

As shown in Table 1, Table 2, and Table 3, the tin-plating materials (Invention Examples 1 to 14) according to Examples 1 to 14 were all good in the friction coefficient, the heat-resistant peeling property, and the solderability. On the other hand, in Comparative Example 1, a result of the relation (C+P)/O was 0.3, which was not good, after the sample was immersed in a solution having a phosphate-based substance of concentration of 1 g/ml, then heat-treated through the reflow. In Comparative Example 2, a result of the relation (C+P)/O was 3.2 and the solderability was 4.52 seconds, which were bad, after the sample is surface-treated and reflow-treated with a solution having a phosphate-based substance of concentration of 50 g/ml. In Comparative Example 3, in the surface-treatment and the reflow-treatment processes, the first heat treatment was performed at 100° C. for 1 second and the second heat treatment was performed at 200° C. for 2 seconds. A fraction in the crystal direction of <2-1-10>‖[001] of the Cu—Sn compound (Cu6Sn5) was 4%, a fraction in the crystal direction of <123>‖[001] of the tin layer was 5%, and a fraction in the crystal direction of <014>‖[001] of the tin layer was 18%. In addition, the friction coefficient was 0.53. Thus, the sample of Comparative Example 3 did not have required properties. In Comparative Example 4, in the reflow-treatment after the surface-treatment, the first heat treatment was performed at 300° C. for 35 seconds, the second heat treatment was performed at 800° C. for 1500 seconds. As a result, a fraction in a crystal direction of <2-1-10>‖[001] of the Cu—Sn intermetallic compound (Cu6Sn5) was 73%, a fraction in a crystal direction of <123>‖[001] of the Sn layer was 68%, and a fraction in a crystal direction of <014>‖[001] of the Sn layer was 2%. In addition, the peeling occurred in the heat-resistant peeling property test. In Comparative Example 5, the tin alloy plating thickness was 4 μm. A fraction in a crystal direction of <2-1-10>‖[001] of the Cu—Sn compound (Cu6Sn5) was 8%, a fraction in a crystal direction of <123>‖[001] of the Sn layer was 9%, and a fraction in a crystal direction of <014>‖[001] of the Sn layer was 15%. Further, the friction coefficient dropped. In Comparative Example 6, the heat-resistant peeling property was deteriorated when the tin plating thickness was 0.05 μm. In Comparative Examples 7 and 8, as a result of the surface-treatment in a dipping method, a surface stain occurred. Thus, the friction coefficient, the solderability dropped. Further, in the phosphate relation, (C+P)/O exceeded 2.5 due to an increase of carbon (C). In Comparative Examples 9 and 10, as a result of the surface-treatment in a spraying method, a small amount of the stain occurred. Thus the friction coefficient and the solderability dropped. Further, (C+P)/O exceeded 2.5 due to a decrease of carbon (C). In Comparative Examples 10 and 11, as a result of the first reflow-treatment after the surface-treatment, a fraction of the Cu—Sn compound (Cu6Sn5) in a crystal direction fraction of <2-1-10> was lower than or equal to 10%, and the stain occurred. Due to an omission of the heat treatment at 200 to 250° C., the bond of carbon (C), phosphorus (P) and oxygen (O) was not formed stably, and value of (C+P)/O exceeded 2.5.

In one example, ratios between intensities in the {111}, {002}, and {022} crystal planes of the nickel plate layer obtained by XRD analyzing the nickel plate layer were showed in Table 4. In the {111}, {002}, and {022} crystal planes, the ratio between intensities I in the {002} and {111} crystal planes satisfies 1.25<I{002}/I{111}<2, and the ratio between intensities I in the {002}, and {022} crystal planes satisfies 10<I{002}/I{022} at the same time.

TABLE 4

| | | Plating condition | | Intensity ratio | |
|---|---|---|---|---|---|
| | | Current | Time | | |
| No. | | (ASD) | (Sec) | I{002}/I{111} | I{002}/I{022} |
| Invention | 8 | 3 | 40 | 1.8 | 13.6 |
| Example | 10 | 3 | 40 | 1.5 | 18 |
| | 12 | 3 | 40 | 1.5 | 13.5 |
| Comparative | 13 | 1 | 4 | 2.9 | 6.7 |
| Example | 14 | 10 | 1500 | 1.1 | 1 |

As may be seen in Table 4, in cases of Invention Examples 8, 10, and 12, plating conditions of the current range of 2 to 7 ASD and the time of 10 to 1000 seconds were satisfied. Therefore, in the XRD results of the obtained nickel plated layers, and in the crystal planes {002}, {111}, and {022}, the respective ratios between intensities I satisfy 1.25<{002}/{111}<2 and 10<I{002}/I{022} simultaneously. Thus, the generated tin-plating materials were all good in the friction coefficient, the heat-resistant peeling property, and the solderability. On the other hand, in Comparative Example 13 (current: 1 ASD, time: 4 seconds or less), the friction coefficients dropped such that I{002}/I{111} was 2.9, and I{002}/I{022} was 6.7. In Comparative Example 14 (current: 10 ASD, time: 1500 seconds), I{002}/I{111} and I{002}/I{022} of the obtained tin-plating material were respectively 1.1 and 1. In addition, the heat-resistant peeling property was deteriorated.

INDUSTRIAL APPLICABILITY

In the instant disclosure, in order to manufacture a plating having excellent insertion force, heat-resistant peeling property, and solderability, a surface-treatment agent was uniformly applied via a mist method, a carbon, phosphorus, and oxygen compound was formed on a tin or tin alloy surface, and crystal structures of Cu—Sn compound ($Cu_6Sn_5$) and Sn layer formed on the surface were controlled through two-step reflow-treatment. Thus, the excellent insertion force was obtained. Further, the surface-treatment agent used in the reflow-treatment is recyclable. In addition, it is advantageous in terms of manufacturing cost because after the surface-treatment, a two-step heat treatment is performed in the reflow step without an additional heat treatment.

What is claimed is:

1. A method for plating tin on a copper alloy for an electric or electronic part or automobile part, the method comprising:

(a) electrolytic-degreasing and pickling a copper alloy base material;

(b) plating an underlying copper layer on the copper alloy base material;

(c) plating a tin or tin alloy layer on the underlying copper layer;

(d) surface-treating the tin or tin alloy layer by mist-spraying a surface-treatment agent thereon to form a product; and (e) reflow-treating the product, wherein the reflow-treatment includes performing a first heat treating of the product at a temperature of 200 to 250° C. for 1 to 30 seconds, then a second heat treating of the product at a temperature of 300 to 700° C. for 3 to 1200 seconds, wherein an EBDS analysis of a resulting product shows that:

a fraction in a crystal direction of <2-1-10>||[001] of a Cu—Sn compound (Cu6Sn5) is in a range of 10 to 60%;

a fraction in a crystal direction of <123>||[001] of the Sn or Sn alloy layer is in a range of 10 to 60%; and a fraction in a crystal direction of <014>||[001] of the Sn or Sn alloy layer is lower than or equal to 10%, and wherein a carbon (C), phosphorus (P), and oxygen (O) compound is present on a surface of the tin or tin alloy plated layer, wherein a relation between C, P, and O is 0.5<(C+P)/O<2.5.

2. The method of claim 1, further comprising plating a nickel or nickel alloy layer before or after the (b) step.

3. The method of claim 2, wherein an XRD analysis of the nickel plated layer shows that a ratio between intensities I in {002} and {111} crystal planes satisfies 1.25<I{002}/I{111}<2, and a ratio between intensities I in {002} and {022} crystal planes satisfies 10<I{002}/I{022}.

4. The method of claim 1, wherein a thickness of the underlying plated layer is in a range of 0.1 to 2.0 μm, and wherein the underlying plated layer includes the copper plating.

5. The method of claim 2, wherein a thickness of the underlying plated layer is in a range of 0.1 to 2.0 μm, and wherein the underlying plated layer includes the copper plating and the nickel plating.

6. The method of claim 1, wherein a thickness of the plated tin layer is in a range of 0.2 to 3.0 μm, a thickness of the Cu—Sn compound after the reflow-treatment is in a range of 0.1 to 1.5 μm, and a thickness of the tin layer after the reflow-treatment is in a range of 0.1 to 1.5 μm.

7. The method of claim 1, wherein the plated tin layer includes at least one selected from a group consisting of Sn, Sn—Ag, Sn—Bi, Sn—Zn, Sn—Pb or combinations thereof.

8. The method of claim 2, wherein the plated nickel layer includes at least one selected from a group consisting of Ni, Ni—Pd, Ni—Co, Ni—Sn, Ni—P or combinations thereof.

* * * * *